United States Patent [19]

Goessler et al.

[11] Patent Number: 5,013,893

[45] Date of Patent: May 7, 1991

[54] HEATING DEVICE

[75] Inventors: Gerhard Goessler, Oberderdingen; Ortwin Schau, Eppingen-Elsenz, both of Fed. Rep. of Germany

[73] Assignee: E.G.O. Elektro-Gerate Blanc u. Fischer, Fed. Rep. of Germany

[21] Appl. No.: 407,205

[22] Filed: Sep. 14, 1989

[30] Foreign Application Priority Data

Sep. 14, 1989 [DE] Fed. Rep. of Germany ..... 3831233

[51] Int. Cl.[5] ..... H05B 3/74

[52] U.S. Cl. ..... 219/453; 219/506

[58] Field of Search ..... 219/453, 506, 465, 448, 219/449, 464, 455, 443; 362/26, 32, 92

[56] References Cited

U.S. PATENT DOCUMENTS

| | | | |
|---|---|---|---|
| 2,140,972 | 12/1938 | Rylsky | 362/26 |
| 2,346,237 | 4/1944 | Rutenber | 219/453 |
| 2,365,864 | 12/1944 | Chapman | 362/26 |
| 2,452,294 | 10/1948 | Dickson | 362/32 |
| 2,480,393 | 8/1949 | Bossert | 362/32 |
| 2,492,100 | 12/1949 | Kitson | 219/453 |
| 2,659,069 | 11/1953 | Kinsella | 362/92 |
| 2,870,316 | 1/1959 | Ferguson, Jr. | 219/37 |
| 3,067,315 | 12/1962 | Hurko | 219/37 |
| 4,052,591 | 10/1977 | Sekera, Jr. et al. | 219/506 |

FOREIGN PATENT DOCUMENTS

| | | | |
|---|---|---|---|
| 0052246 | 5/1982 | European Pat. Off. | 219/453 |
| 42818 | 7/1887 | Fed. Rep. of Germany | 362/32 |
| 7026934 | 7/1970 | Fed. Rep. of Germany . | |
| 2315220 | 10/1973 | Fed. Rep. of Germany . | |
| 7630251 | 9/1976 | Fed. Rep. of Germany . | |
| 3434536 | 3/1986 | Fed. Rep. of Germany . | |
| 3501365 | 7/1986 | Fed. Rep. of Germany . | |
| 3603324 | 8/1987 | Fed. Rep. of Germany . | |
| 1099080 | 8/1955 | France | 362/26 |
| 536887 | 5/1941 | United Kingdom | 362/32 |
| 1346574 | 2/1974 | United Kingdom . | |
| 1406028 | 9/1975 | United Kingdom . | |

*Primary Examiner*—Teresa J. Walberg

*Attorney, Agent, or Firm*—Eckert Seamans Cherin & Mellott

[57] ABSTRACT

In a radiant heater (1) an illuminated display (20) is provided for at least part of the heating field (12) and has a low voltage halogen lamp (22) and a glass rod light guide (30) located at a limited distance below the glass ceramic plate (2) and led away from the lamp with at least one light entrance (32). The light guide circularly, spacedly surrounds the outer circumference of the heating field (11) with a display portion and over the length of the latter are distributed light exits (40) in the form of notches (44) or the like. Thus, a corresponding, horizontal, circular display field (45) is formed on the outside (4) of the glass ceramic plate (2). Thus, even when a cooking utensil is in place, the illuminated display (20) can be seen from a considerable distance and the lamp (22), protected against overheating, can be located outside the heated area.

51 Claims, 2 Drawing Sheets

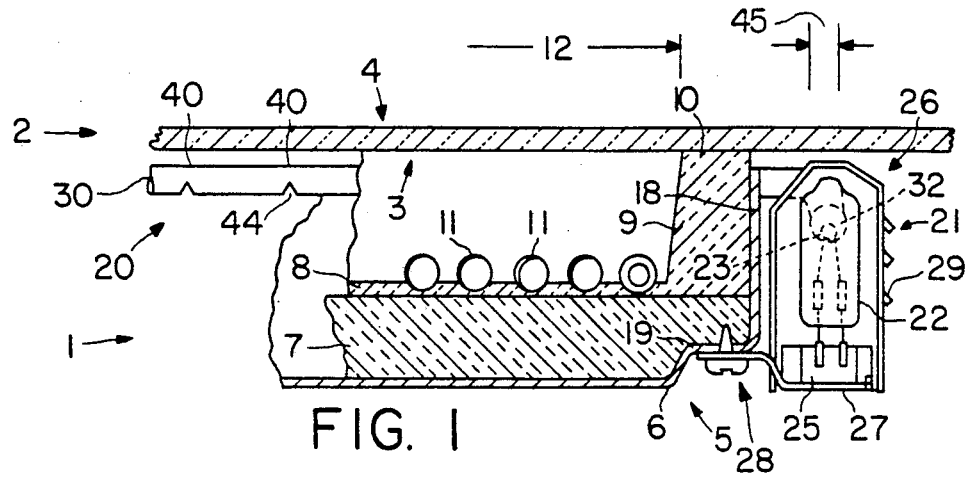
FIG. 1
FIG. 2
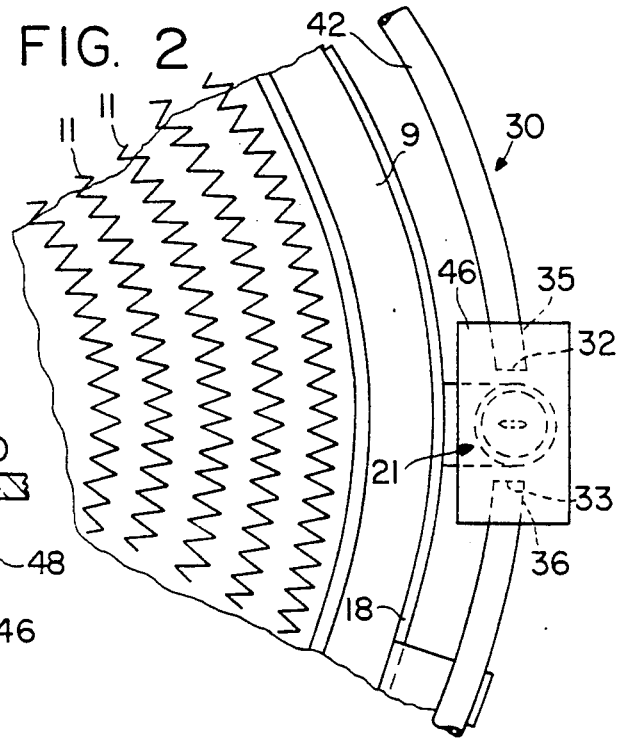
FIG. 4
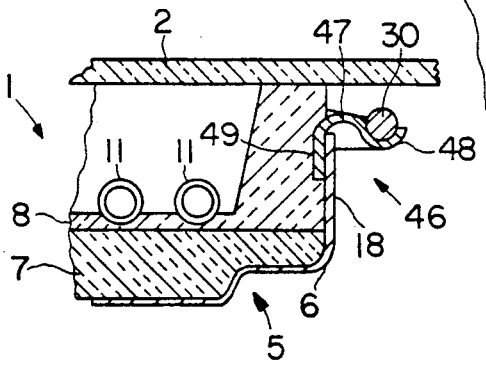
FIG. 3
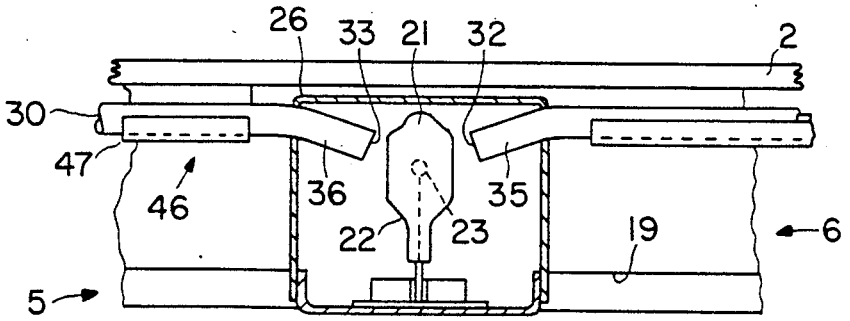

HEATING DEVICE

BACKGROUND OF THE INVENTION

1. Field of the Invention

The invention relates to a heating device more particularly intended for cooking and which has at least one illuminated display.

2. Prior Art

British Patent 1,346,574 discloses an illuminated display for a radiant heater, in which the light beam path between the light source and the glass ceramic plate is substantially influenced by a concave mirror, which not only causes problems from the technical and space standpoints, but also fails to provide long-lasting operational reliability, because under the loads in a radiant heater mirrors rapidly lose reflectance.

There can also be a certain light beam path within the glass ceramic plate, so that e.g. a central light source is still slightly visible in the marginal area of the glass ceramic plate, but for this purpose the light source must be very close to the plate and the latter must also have an edge which must be carefully kept clean and which surrounds the individual heating field, which is deliberately avoided in the case of glass ceramic plates having several heating fields, for known reasons.

SUMMARY OF THE INVENTION

An object of the invention is provide heating device of the aforementioned type, in which one criterion of state of the heating field can be displayed in a readily visible manner by illumination in a simple manner, at an appropriate point and with a suitable extension.

According to the invention this object is achieved by the arrangement of at least one strand-like light guide, which guides the light to at least one display point within its scattering range. The separate light guide makes it possible to on the one hand fit the light source and on the other the illuminated display at virtually any random point and independently of one another and to connect same by the physical light guide, in which the light is directed within an envelope bounding the same. The light source can be positioned on the underside of the radiant heater, remote from the latter, e.g. together with further light sources for further heating fields, or at some other point. The light exit for the illuminated display can be located on the inside or bottom of the glass ceramic plate, within the heating field, in a visible field with illuminated displays for further heating fields of the same cooker plate, in the vicinity of the instrument panel or at some other point, any random combination of the above arrangements being made possible e.g. in that for each heating field two or more light guides are provided, which are operated by a single joint or several light sources. It is also possible to line up separate light guides in series or for forming branches of the light beam path. The heater can in particular be a radiant heater, but also an induction heater or contact heater, etc. The measures according to the invention can be used wherever heating takes place through a translucent or transparent plate.

It is particularly advantageous to arrange the illuminated display in substantially uniform distribution around the outer circumference of the heating field, particularly radially outside the heating resistors or radially outside an outer bearing edge or border of the support or outside the field which is conventionally covered by the bottom of a cooking utensil to be heated.

Advantageously there is a single light guide for the particular heating field or the particular heating field part, said light guides having at both rod ends light entrances for the same light source. The light guide can be positioned very close to the glass ceramic plate, while the light source can be further removed therefrom or shielded with respect to the glass ceramic plate.

If the light guide is located in the thermally less stressed areas of the cooker plate or radiant heater, then it can be formed by a simple, in particular multiply curved glass rod, whereas it is appropriately formed by a quartz glass rod when located in thermally more highly stressed areas. The light guide can also comprise a bundle of light conducting fibers, which then terminate in different length regions of the light guide for forming light exits. The cross-sections of the light guide can alternate for adapting to the particular spatial requirements and the light guide can have flatter cross-sections, e.g. in the area where it is pass a rod-like temperature sensor in intersecting manner. The cross-sections can be circular, semicircular, flat-oval, etc. The transition between different cross-sections is, if desired, selected in such a way that there is no coupling out of light. In the case of a heating system leading only to low light guide temperatures, e.g. an induction heating system, the light guide can also be made from plastic.

The light source or the light entrance or inlet to the light guide can be connected in such a way that there is both an indication for the on and off state of the associated heating field, as well as for its hot state, i.e. the same light source or a second light source supplies the illuminated display with light via the light guide until the temperature of the heating field has dropped below a specific, uncritical value. It is particularly advantageous to use a circuit, in which the illumination intensity of the illuminated display or the light source is continuously or stepwise modified in such a way that e.g. with each power setting of the manual switching device for the heating field is associated a specific illumination intensity. Appropriately the illumination intensity increases as the power setting becomes higher. Thus, the user is provided with a criterion for the level of the selected setting, which is initially a desired value setting and cannot therefore be directly detected on the heating field or on the heating resistors.

These and further features of preferred further developments of the invention can be gathered from the claims, description and drawings. The individual features can be realized individually or in the form of subcombinations in any embodiment of the invention and in other fields and represent advantageous, independently protectable constructions for which protection is claimed here.

BRIEF DESCRIPTION OF THE DRAWINGS

The invention is described in greater detail hereinafter relative to embodiments and the attached drawings, wherein:

FIG. 1 is a detail of a radiant heater arranged on a glass ceramic plate in axial section.

FIG. 2 is a plan view of the radiant heater according to FIG. 1.

FIG. 3 is a radiant heater according to FIG. 2 in a view from the right and straightened out.

FIG. 4 is another detail in a view corresponding to FIG. 1.

DETAILED DESCRIPTION OF THE PREFERRED EMBODIMENT

Figure 5:
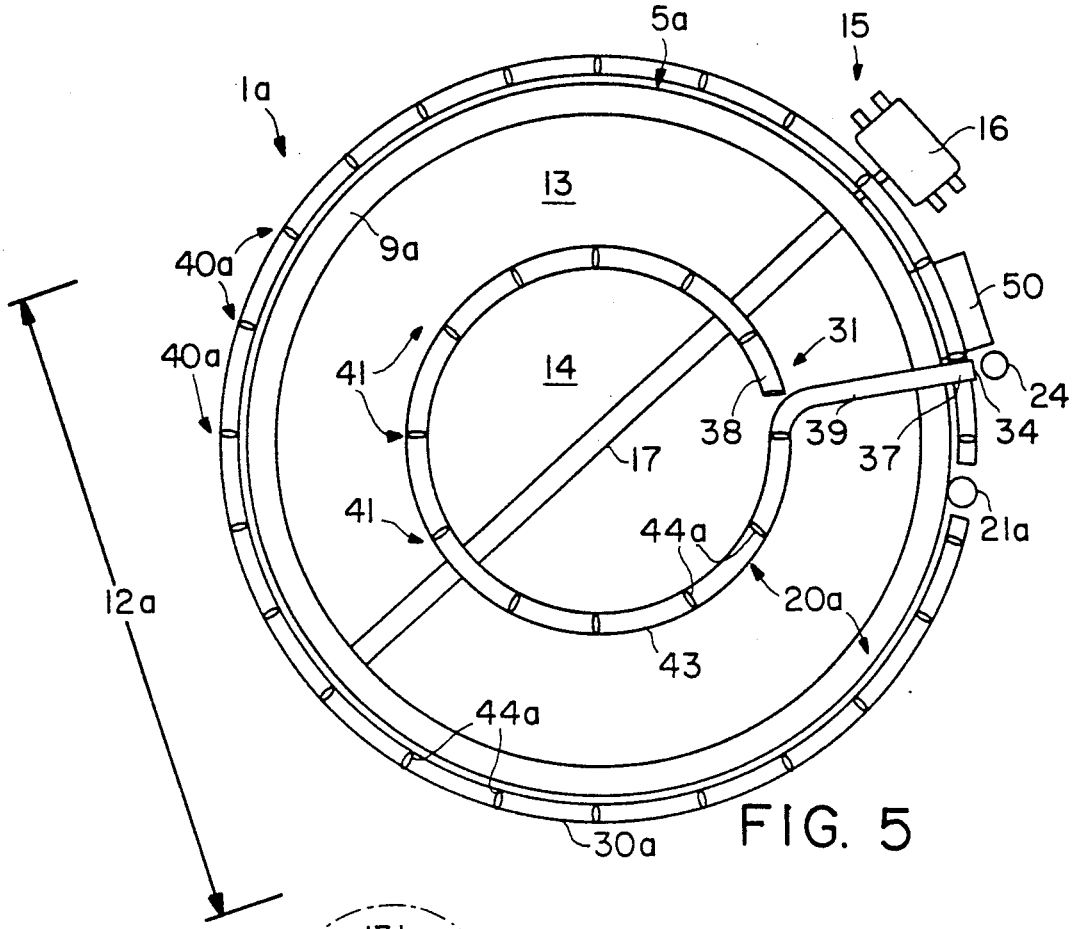
FIG. 5 is a further embodiment of a radiant heater in simplified plan view.

According to FIG. 1 a heating unit for heating at least one cooking field or the like comprises a closed circular or polygonal radiant heater constituting a fittable component, which is arranged on the inside 3 of a planar glass ceramic plate 2, whose outside 4 can receive a cooking utensil.

The radiant heater 1 has a shell-like carrier 5 with an outer sheet metal support shell 6, a relatively dimensionally unstable, mineral insulation 7 arranged on its bottom and a one or multi-part, shell-like shaped body, which forms an insulating carrier 8 for at least one radiant heater body 11, such as a substantially exposed resistance coil and/or at least one halogen lamp, as well as an outer border 9 projecting against plate 2 and forming the outer circumference thereof and whose end face, as the bearing face 10 determining the bearing plane, is provided for substantially thermally and airtight engagement on the inside 3 of plate 2. The heating field 12 of the cooking surface is determined by the heating resistor 11 or the inner circumference of the outer border 9. The border 18 of support shell 6 is set back slightly with respect to the bearing plane and passes via a ring shoulder 19 slightly displaced with respect to the bearing plane into the shell bottom.

For indicating the state of the heating field, e.g. for indicating whether it is on or off, the manually set desired power and/or the actual temperature with respect to a limit value, there is an illuminated display 20 with a light source 21 having a halogen lamp 22 and whose filament 23 is enclosed in a transparent bulb and is electrically connected to at least one display circuit by its easily detachable insertion in a holder 25. Light source 21 is immediately adjacent to the outer circumference of carrier 5 in a casing 26 extending approximately over the entire height of carrier 5, which is slightly set back with respect to plate inside 3, has in the circumferential direction a greater extension than radially to the radiant heater 1 and substantially completely protects on all sides lamp 22 and plate 2 with a dome-shaped casing part engaged in easily raisable manner on a socket 27 carrying holder 25. A vent system 29 formed by openings in the casing dome part cools lamp 22.

From the interior of casing 26 the light substantially exclusively passes out through at least one light guide 30, which has within the casing 26 two facing light entrances or inlets 32, 33 directed at the filament 23 and whose optical axes are at an obtuse angle to one another opening towards the bearing plane. Each light entrance 32 or 33 is formed by the end face of one of the two ends 35, 36 of a one-piece light guide rod made from transparent material, whose circumferential surface has the smoothness resulting from the glass melt or the like over most of its length. Ends 35, 36 are passed through closely matched openings in the end walls of casing 26 and are slightly bent away from the bearing plane, so that the filament 23 can have a greater distance from the bearing plane than most of the light guide 30 substantially parallel thereto. The distance between light guide 30 from the bearing plane can be roughly the same as its cross-sectional width or less. Light guide 30 is substantially equiaxial to the heating field 12 or can be parallel adjacent to the outer circumference of carrier 5 with a distance therefrom, so that in the illuminated state it can form a readily visible light pattern through plate 2 surrounding the cooking field 12 and transparent at least in its vicinity.

At a distance from the coupling in of light in the vicinity of light entrances 32, 33, the light guide 30 has for light coupling out purposes numerous, e.g. substantially uniformly distributed light exits 40, which can be essentially provided over the entire circumference of light guide 30 and forming in this area and through the presence of the light exits a substantially circular display portion 42 used directly for the illuminated display. Each light exit 40 is formed by at least one prismatic reflection flank inclined to the bearing plane passing through the outer circumference of light guide 30, e.g. under an angle of about 45°, or by a corresponding V-shaped circumferential notch 44, which could be located at a random point of the light guide circumference, but is preferably on the side remote from the bearing plane thereof.

In order to produce the light exit instead of this or in addition thereto there can be a continuous surface grooving, a roughened surface of light guide 30 produced e.g. by chemical etching, sandblasting or the like, so that both a chain of lined up light dots and also a continuous, substantially uniformly lighting up ring can be created. The light exits 40 create in the vicinity of outside 4 of plate 2 a circular display field 45, which is at a distance outside the heating field 12.

The light guide 30 is secured on the one hand by its connection to casing 26 and on the other by a separate mounting support 46 over its entire circumference and engaging in substantially uniform manner. This support can also pass continuously as a ring in substantially uninterrupted manner over the length of the display portion 42 or light guide 30 and appropriately brings about the elastically resilient mounting of light guide 30, so that the latter does not break under the mechanical stresses and thermal expansions which occur in practice. Casing 26 with a mounting support 28 provided on its socket 27 is fixed to the ring shoulder 19, e.g. by screws.

The mounting support 46 is provided either on a thin-walled sheet metal ring which is almost closed or extending on both sides approximately up to casing 26, or on holding clips 47 distributed uniformly over the circumference, a channel profile 48 substantially open towards the bearing plane and adapted to the cross-section of light guide 30 and in which the latter is resiliently mounted. The cross-sectionally roughly semicircular channel profile 48 passes into a radially inner ring jacket part, fastening tongues 49, etc., with which the mounting support 46 is fixed to carrier 5 or the border 18 of support shell 6. The fastening tongues 49 or the like can engage over the front edge of the shell border 19 and hang on the inside of shell border 18 and be secured by the insulating carrier outer border 9, but they can also be fixed by screws or the like.

Through the outside arrangement of lamp 22, its temperature stressing is much less than when it is located within the radiant heater, so that it is possible to use halogen lamps with a resistance glass bulb instead of a quartz bulb. Casing 26 is appropriately constructed on the inside with a reflecting surface and on the outside with a light-absorbing, particularly black surface.

The embodiment according to FIG. 5 involves a so-called two-circuit radiant heater 1*a*, whose maximum operable heating field 12*a* has a central heating field part 14 and at least one heating field part 13 surrounding the same and which in each case have separate, manually separately operable radiant heaters not shown, so that in particular only the central heating field part 14 alone or both heating field parts 13, 14 can be jointly operated. An annular inner border of the insulating carrier extending up to the engagement plane separates the heating field parts 13, 14 both thermally and with respect to their associated display fields from one another. As an overheating protection is provided a thermal cutout 15, which is also conceivable in the embodiment according to FIGS. 1 to 4 and whose casing 16 is located outside the common carrier 5*a* for the two heating field parts 13, 14 and has a rod-shaped temperature sensor 17, which crosses the two heating fields in closely adjacent manner and roughly parallel to the bearing plane. It passes through the outer border 9*a* and inner border of carrier 5*a* in narrow openings and is appropriately located on the side of the particular display portion of at least one light guide remote from the bearing plane and very close thereto.

Apart from the light guide 30*a* or the associated display field for the state display of at least the outer heating field part 13 or in the case of joint operation both parts 13, 14, when the central heating field part 14 is operated alone, a further light guide 31 is provided, whose circular, approximately closed display portion 43, e.g. provided with pressed-in notches 44*a* can be located on or outside the outer circumference of the inner border of the insulating carrier or substantially in the end face of said inner border and as a result can be secured thereon.

One end of the display portion 43 used directly for the illuminated display substantially radially to the cooking field 12*a* is bent outwards to a substantially linear light connecting portion 39 used only for light guidance and not for direct illuminated display purposes and which is free from light exits and whose radially outer end 37 forms with its end face the only light inlet 34 of said light guide 31, with which is associated a separate light source 24, which is appropriately constructed like light source 21*a* and located on the outer circumference of carrier 5*a* close to the latter.

The reciprocally appropriately shielded light sources 21*a*, 24 can be provided in separate casings or a joint casing. The other end 38 of light guide 31 extends approximately up to the bend of the connecting portion 39. For avoiding uncontrolled and undesired light phenomena it can preferably be silvered. The light exits of light guide 31 are designated 41 and through the described construction associated with a separate, circular display field. Otherwise FIG. 5 has the same reference numerals for corresponding parts as in FIGS. 1 to 4, so that there is no need to describe them again.

The inventive illuminated display 20 or 20*a* is appropriately operated with weak current or low voltage halogen lamps, which are either supplied by a voltage tap of the heater coil forming the associated radiant heater, or by a separate transformer.

The illuminated display or its lamp or lamps can be connected by means of a signal contact of the switching device for the manual setting of the radiant heater and said signal contact can switch the illuminated display lamp parallel to a hot indication contact of the thermal cutout. In the case of separate illuminated displays for two heating circuits a switch-in contact provided on the switching device for the outer heating circuit is appropriately mechanically connected to a control contact, which is arranged in a relay circuit with a self-holding contact, the relay circuit cooperating in the hot display circuit of the lamps. By interposing a diode or the like, the light intensity in the case of the hot display can be lower. The hot state for both heating field parts can be so separately displayed, that in the case of a hot central heating field part only the associated display field is lighted up, whereas in the hot state of both heating field parts both display fields light up. U.S. Pat. No. 4,794,233 (DE-OS 36 35 345) discloses circuit configurations for the illuminated display and reference should be made thereto for further details and effects. On the outer circumference of the carrier 5*a* is appropriately provided a terminal 50 preferably formed by a multi-pin plug for the electrical connection of the illuminated display 20*a* to the switching device.

Figure 6:
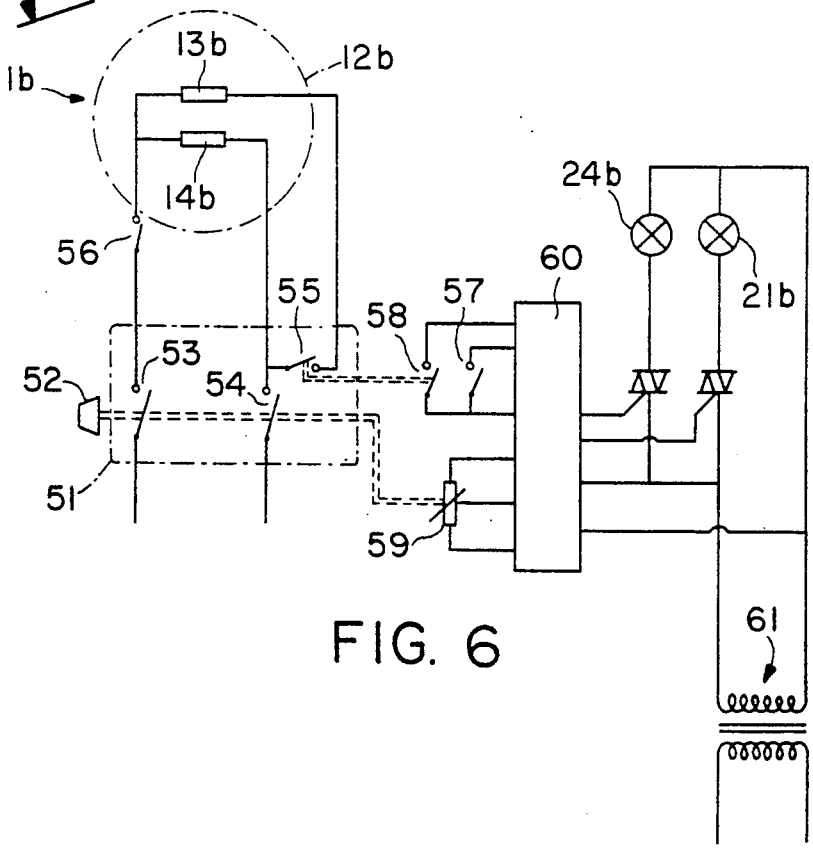
FIG. 6 is a circuit for an illuminated display.

FIG. 6 shows a circuit configuration for a two-circuit radiant heater with associated illuminated displays, in which the illumination intensity of the lamps 21*b*, 24*b* or both light guides can be controlled independently of the desired value setting of the manual switching device 51, so that the user is provided with a criterion for the level of the selected settings.

The switching device 51 to be operated with a control toggle 52 or the like and which is appropriately constructed as a timed energy or power regulator, e.g. has contacts operable by means of an adjusting spindle, namely for both mains leads in each case one switching contact 53, 54 and for the radiant heater 13*b* of the outer heating field part of radiant heater 1*b* to be connected in a switch-in contact 55. The latter is mechanically coupled to a signal contact 58, while the adjusting spindle adjusts a setpoint adjuster 59, e.g. a potentiometer, which in the same way as the signal contact 58 and a hot indication contact 57, influences control electronics 60. The hot indication contact 57, besides the cutout contact 56, is a further thermal cutout contact switched by the temperature sensor.

On the input side control electronics 60 is subject to the action of the potentiometer, which is mechanically coupled to the power control or switching device 51 and on the input side of the control electronics 60 are provided the signal contact 58 mechanically coupled to the switch-in contact 55 for the second heating circuit as well as the hot indicating contact 57.

On the basis of the information from these circuit parts, the circuit controls the lamps 21*b*, 24*b* continuously from a maximum luminosity in the case of the maximum setting of the power control device to a predetermined minimum value for the lowest setting. At the end of the cooking process and on switching off the power control device, the lamps 21*b*, 24*b* light up until the hot indication contact 57 opens. If only the radiant heater body 14*b* of the central heating field part is switched on, then only lamp 24*b* lights up and if the radiant heater bodies 13*b*, 14*b* of both heating field parts are switched on, then both lamps light up. Otherwise FIG. 6 uses the same reference numerals as in the other drawings for corresponding parts, but followed by the letter b, so that there is no need for a further description thereof. FIG. 6 also shows the transformer 61 for operating the lamps with low voltage current.

Whereas in the case of the represented embodiment lamp 21 is positioned vertically, it could also be positioned horizontally. In this case the ends of the light guide would not be bent out of the plane thereof, cf. FIG. 3, but would instead be bent radially outwards in the plane.

The inventive construction is inter alia substantially suitable for all cooking systems, in which the energy source for the heating is positioned above, on or below a transparent or translucent glass, glass ceramic or similar plate. For example the induction coil of an induction cooking point can be positioned below such a plate. Instead of or in addition thereto it is also possible to install an electric hotplate, which e.g. has a metallic hotplate body, in an opening of a resistance glass hob.

We claim:

1. A heating device comprising:

at least one front member providing a heater screen;

at least one heater having at least one heating element supported by a heater carrier and defining at least one heating field;

at least one display means for a state indication provided for indicating a state of said heating device, said display means having at least one light source and at least one illuminatable display field in a vicinity of said heater screen and, connected by means of a light beam path to the light source, wherein said beam path is formed by at least one light guide separate from but at least partially directly adjacent to said heater screen, and light guide having at least one light exit for at least one said at least one display field and at least one light inlet associated with at least one said at least one light source.

2. The heating device according to claim 1, wherein said at least one light exit for at least one said at least one display field is directly formed by a deflecting light exit of said guide forming a display portion in a vicinity of each said at least one exit, and illuminates directly through a translucent portion of said heater screen.

3. The heating device according to claim 1, wherein at least one said at least one light guide is constructed in a substantially rod-like manner, and has at least one arched bent portion.

4. The heating device according to claims 1 or 3, wherein at least one said at least one light guide has substantially constant cross-sections over most of an entire length extension thereof.

5. The heating device according to claim 3, wherein at lest one said at least one light guide has light exits distributed over a rod length, and around at least a part of one said at least one heating field.

6. The heating device according to claims 1 or 3, wherein at least one said at least one light guide is constructed for light guidance substantially only within an outer circumference provided behind said heater screen.

7. The heating device according to claim 1, wherein at least one said at least one light guide has two ends, at least one of said ends being constructed as a light inlet located behind said heater screen.

8. The heating device according to claims 1 or 7, wherein at least one said at least one light inlet is arranged in at least one of a position directly adjacent and a position radially oriented to a lamp provided behind said heater screen.

9. The heating device according to claim 1, wherein at least one said at least one light guide is arranged substantially in a plane parallel to a main plane of said front member, at least one said at least one light exit being adapted to illuminate directly through said heater screen.

10. The heating device according to claim 1, wherein at least a portion of at least one said at least one light guide is constructed in an annular and substantially closed manner, said portion being located adjacent to a circumference of said carrier of said heater.

11. The heating device according to claim 1, wherein at least a section of said light guide providing at least one said at least one light exit is arranged substantially in a plane parallel to and behind said heater screen.

12. The heating device according to claim 1, wherein an annular portion of at least one said at least one light guide provides said display portion, and has a number of spaced light exits behind said heater screen.

13. The heating device according to claim 1, wherein at least one said at least one light guide is located at least partly directly adjacent to a front member bearing plane of said heater carrier, said bearing plane being defined by an end face of at least one circumferential border of said heater carrier.

14. The heating device according to claim 13, wherein at least one said at least one light guide has at least one light inlet section spaced by a distance from said bearing plane of said heater carrier, said distance increasing towards at least one said at least one light inlet.

15. The heating device according to claim 1, wherein at least one said at least one light guide is arranged substantially symmetrically to a center axis of at least one said at least one heating field.

16. The heating device according to claim 1, wherein at least one said at least one light guide is arranged substantially equiaxial to at least one said at least one heating field.

17. The heating device according to claim 1, wherein at least one said at least one light guide is located substantially outside of and adjacent to an outer circumference of at lest one said at least one heating field.

18. The heating device according to claim 1, wherein at least one said at least one light guide is located substantially in a vicinity of an outer circumference of at least one said at least one carrier.

19. The heating device according to claim 1, wherein at least one said at least one light guide is located substantially directly adjacent along an outer circumference and outside of at least one said at least one heater carrier.

20. The heating device according to claim 1, wherein at least one said at least one light guide is arranged within at least one said at least one heating field and directly adjacent to said heater screen.

21. The heating device according to claim 20, wherein said at least one heater is a radiant heater having an inner heating field section and at least one supplemental heating field section at least partly surrounding said inner heating field section, separate light guides being provided for said heating field sections.

22. The heating device according to claim 21, wherein said at least one light guide is arranged in a vicinity of an end face of a circumferential border surrounding said inner heating field section, the border providing an insulating material.

23. The heating device according to claim 1, wherein at least one said at least one light guide has a light conducting connecting portion free from light exits and passing in outwardly directed manner from said display portion substantially radially to a center axis of said heating field.

24. The heating device according to claim 1, wherein at least one said at least one light guide is made from a transparent material.

25. The heating device according to claim 1, wherein at least one said at least one light guide is made from a glass-like material.

26. The heating device according to claim 1, wherein at least one said at least one light exit is formed by at least one of means including a surface profiling, a notch and a roughened portion, said at least one light guide having a melt-smooth circumferential surface apart from said at least one light exit.

27. The heating device according to claim 1, wherein at least one said at least one light guide is positionally secured to said heater carrier in at least one region spaced from at least one said at least one light entrance.

28. The heating device according to claim 1, wherein at least one said at least one light guide is positionally secured to said heater carrier in a vicinity of said display portion.

29. The heating device according to claim 1, wherein at least one said at least one light guide is positionally secured with at least one mounting support self-adapting to thermal stress expansions.

30. The heating device according to claim 29, wherein at least one said at least one mounting support partly surrounds said light guide on a side remote from a bearing plane of said heater carrier.

31. The heating device according to claim s 29 or 30, wherein at least one said at least one mounting support is channel-like, said at least one mounting support providing at least one holding clip.

32. The heating device according to claim 31, wherein a number of holding clips are distributed over a length extension of said light guide.

33. The heating device according to claims 29 or 30, wherein at least one said at least one mounting support is fixed to an outer support shell of said heater carrier.

34. The heating device according to claim 1, wherein at least one said at least one light source is arranged in a casing, at least one said at least one light guide and at least one said at least one light source being fixed to said heater carrier.

35. The heating device according to claim 34, wherein said casing shields said at least one light source relative to a plate bearing plane of said heater carrier.

36. The heating device according to claim 34, wherein said casing substantially completely surrounds said at least one light source, at least one said at least one light guide projecting with at least one light inlet into said casing, the casing being located adjacent to a circumference of said heater carrier.

37. The heating device according to claim 34, 35 or 36, wherein said casing is fixed to said heater carrier.

38. The heating device according to claims 34, 35 or 36, wherein said casing is fixed to an outer support shell of said heater carrier.

39. The heating device according to claims 34, 35 or 36, wherein said casing is provided with a vent system.

40. The heating device according to claims 34, 35 or 36, wherein in at least one of first extension directions defined by a longitudinal extension of said at least one light guide and a circumferential extension of said heater carrier, said casing has a greater extension than in at least one of second extension directions defined by an extension at right angles to said first extension direction and a radial extension of said carrier.

41. The heating device according to claim 1, wherein at least one said light source is controlled for providing differing luminosity as a function of a desired value setting on a switching device provided for manual setting of said heater.

42. The heating device according to claims 1 or 41, wherein at least one said light source is operated at low voltage.

43. The heating device according to claims 1, or 41, wherein at least one said light source is controlled to provide a continuous change of luminosity.

44. The heating device according to claim 1, wherein at least one said heater has at least one of members formed by a radiant heater, an induction heating system and an electric hotplate.

45. The heating device according to claim 1, wherein at least one said at least one heating field forms a cooking field with a standing surface for a cooking utensil.

46. The heating device according to claim 1, wherein said front member is a plate.

47. The heating device according to claim 1, wherein said front member is a glass ceramic plate.

48. The heating device according to claim 1, wherein said state indications signal at least one of states of at least one heating field, including an on-off state and a temperature state.

49. The heating device according to claim 1, wherein said at least one said at least one light source is an electric lamp.

50. The heating device according to claim 1, wherein at lest one said at least one light guide provides at least one of sections defined by an arched section and an angle section.

51. The heating device according to claim 1, wherein at least one said at least one light guide is borne by said heater carrier.

* * * * *